United States Patent [19]

Blubaugh

[11] Patent Number: 4,783,929

[45] Date of Patent: Nov. 15, 1988

[54] GUARD APPARATUS FOR SHROUDING SPRING LOADED GARAGE DOOR HARDWARE

[75] Inventor: Terry L. Blubaugh, Diamond Bar, Calif.

[73] Assignee: Holmes-Hally Industries, Los Angeles, Calif.

[21] Appl. No.: 93,183

[22] Filed: Sep. 4, 1987

[51] Int. Cl.[4] ..... E05D 15/40

[52] U.S. Cl. ..... 49/206; 49/204; 160/192

[58] Field of Search ..... 49/203, 206, 205, 204; 160/191, 192

[56] References Cited

U.S. PATENT DOCUMENTS

| | | | |
|---|---|---|---|
| 1,857,756 | 5/1932 | Headley | 160/191 |
| 1,983,856 | 12/1934 | Johnson . | |
| 2,023,909 | 12/1935 | Wread . | |
| 2,171,194 | 8/1939 | Smith . | |
| 2,195,875 | 4/1940 | Pixley . | |
| 2,530,629 | 11/1950 | Pringle . | |
| 2,531,119 | 11/1950 | Everitt . | |
| 2,751,219 | 6/1956 | Dodge . | |
| 3,146,825 | 9/1964 | Briggs et al. . | |
| 3,202,415 | 8/1965 | Lodge . | |
| 3,349,516 | 10/1967 | Armstrong . | |
| 3,402,922 | 9/1968 | McCan . | |
| 3,429,072 | 2/1969 | Sammons . | |
| 3,680,259 | 8/1972 | Andresen . | |
| 3,858,452 | 1/1975 | Gatland et al. . | |
| 3,958,367 | 5/1976 | Fairman . | |
| 4,057,235 | 11/1977 | Halopoff . | |
| 4,082,133 | 4/1978 | Halopoff . | |
| 4,235,047 | 11/1980 | Turner . | |
| 4,601,131 | 7/1986 | Ozols . | |

FOREIGN PATENT DOCUMENTS

| | | | |
|---|---|---|---|
| 1409521 | 10/1968 | German Democratic Rep. | 49/203 |
| 1242573 | 8/1971 | United Kingdom | 49/203 |
| 1246214 | 9/1971 | United Kingdom | 49/203 |

*Primary Examiner*—Peter A. Aschenbrenner
*Assistant Examiner*—Gerald A. Anderson
*Attorney, Agent, or Firm*—Fulwider, Patton, Rieber, Lee & Utecht

[57] ABSTRACT

First and second generally harp shaped guard halves, one being formed with a vertical mounting flange for attachment to the garage door jamb adjacent the hardware to be shrouded and each being formed with co-extensive planar walls projecting along the opposite sides of the hardware and formed with inturned peripheral flanges rounding the top and vertical length thereof for complementally mating together to generally shroud the hardware within such guard apparatus.

12 Claims, 2 Drawing Sheets

FIG. 1
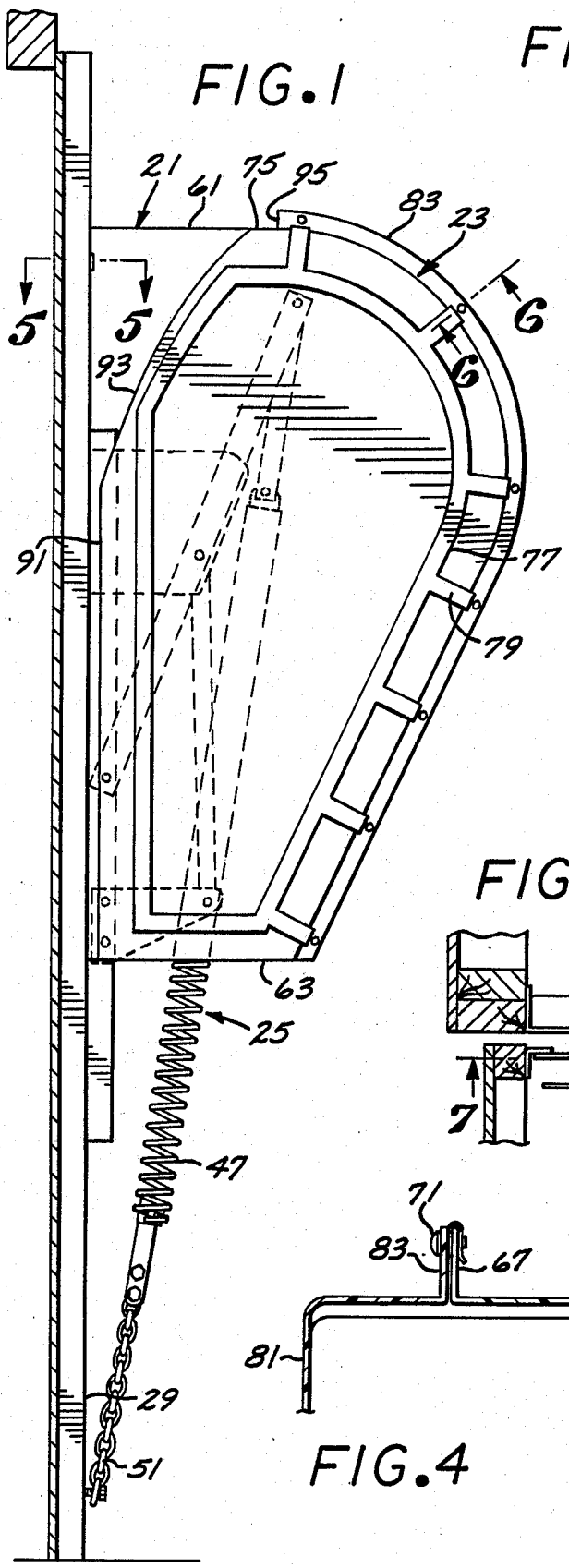
FIG. 2
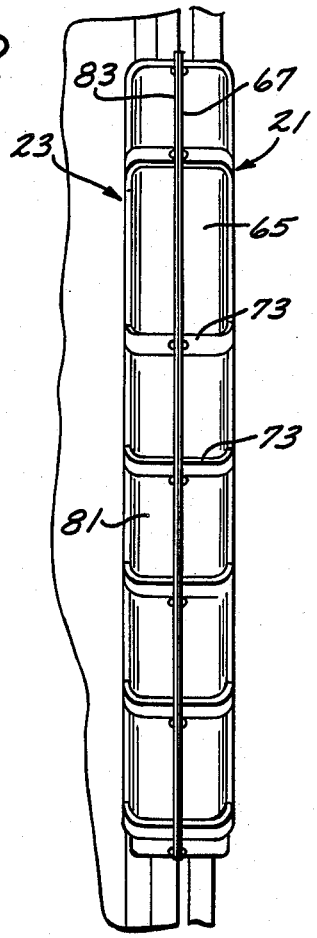
FIG. 3
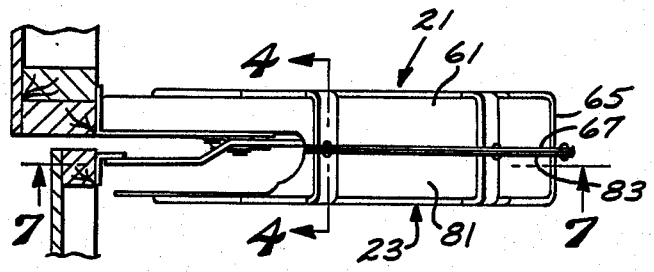
FIG. 4
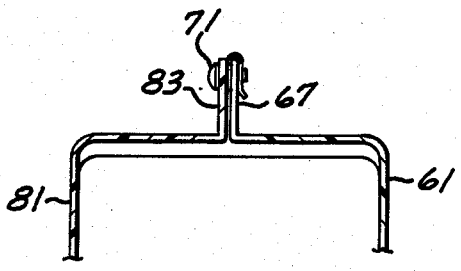
FIG. 5
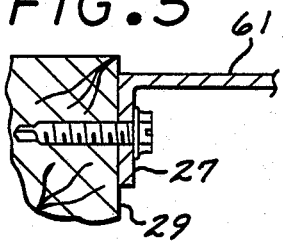
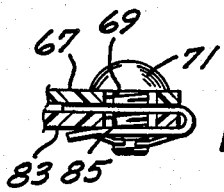
FIG. 6

GUARD APPARATUS FOR SHROUDING SPRING LOADED GARAGE DOOR HARDWARE

BACKGROUND OF THE INVENTION

1. Field of the Invention

The present invention relates to a safety guard for shrouding the garage door hardware mounting a one-piece garage door to protect against escape of pieces or segments of a loaded garage door spring in the event of rupture.

2. Description of the Prior Art

It has long been the practice in certain parts of the country to mount one-piece garage doors from the garage door jambs by means of linkage mechanisms intended to carry the door from its vertical closed position to a horizontal overhead position. To assist in lifting the door, which may weigh on the order of 100 to 200 lbs., the hardware is typically counter-balanced by a strong spring which, when the door is closed, is typically under high tension to thus store energy available to assist in the opening of the door. The springs themselves are subject to limited life and after several years of use will progressively fatigue creating a danger that the spring will rupture while under tension often resulting in the free end of the ruptured spring flailing about in an uncontrolled manner or even becoming detached and disassociated from the hardware itself to be propelled through a trejectory dictated by the particular configuration at the time of breakage. Such uncontrolled release of energy and flying projectiles can cause great injury to the person or individuals in the general proximity at the time of rupture and can do substantial damage to the paint or even body of an automobile housed in the garage.

Many efforts have been made over the years to provide satisfactory safety mechanisms for holding the loose spring parts captive in the event of ruptures. One such device incorporates a pair of telescopical tubular members which may be telescoped over the periphery of such garage door springs or, if desired, telescoped within the confines of the spring. A device of this type is showing U.S. Pat. No. 3,402,922 to H. F. McCan. Such devices, while satisfactory for their intended use, suffer the shortcoming that the parts thereof must telescope relative to each other each time the door is opened and closed thus, necessitating periodic lubrication of the moving parts and creating a problem with free telescopical travel thereof in the event of misalignment or denting of the walls of the tubes. Additionally, such mechanisms are expensive to manufacture and are time-consuming and awkward to install thus discouraging use thereof.

Other efforts have led to the proposal that tether ropes or wire cables be threaded through the interior of such springs to be anchored at the opposite ends to the hardware or door in effort to limit travel and escape of the free ends of ruptured springs or disassociated parts thereof. Such devices suffer the shortcoming that the task of installing the tether rope or wire is time-consuming and the tether, when the spring moves from its extended condition to its retracted condition, experiences slack in the length thereof thus freeing it for possible catching between the coils of the spring or even extending from the end of the spring creating a free loop. Such slack loops have been known to function as a lasso in trapping the limbs of children or pets when the garage door is subsequently closed, the spring stretched, and the tether tightened and the loop or lasso closed. The relatively high forces involved can cause severe injury.

Other efforts have led to the construction of the springs having hairpin shaped retaining wires inserted therein in telescopical interlocking relationship and secured at their opposite ends to anchor fittings at the opposite ends of the spring. Such a device is shown in U.S. Pat. No. 4,057,235 to William Halopoff, applicant being the owner of that patent by assignment. Such a retained spring, while affording significant safety protection and being relatively economical to manufacture, still leaves the garage door hardware itself exposed and subjects passersby to the danger of injury from a released spring or spring fragment in the event the anchor chain or bolts at one or the other end of the spring gives loose.

Thus, there exists a need for a guard which will shroud the entire linkage making up the garage door hardware to afford total safety while covering the hardware itself from view.

With these and other objectives in view, the invention consists of the construction, arrangement, and combination of the various parts of the device, whereby the objectives contemplated are attained, as hereinafter pointed out in the appended claims and illustrated in the accompanying drawings.

SUMMARY OF THE INVENTION

The present invention is characterized by a pair of complementally shaped guards incorporating planar walls projecting co-extensively on the opposite sides of hardware mounting a one-piece garage door, one of such half being formed with a mounting flange for mounting the guard assembly from the door jamb. The halves are formed with inturned peripheral flanges which surround the top and three vertical sides thereof to cooperate with the planar walls in fully encapsulating the hardware.

Other objects and features of the invention will become apparent from consideration of the following description taken in connection with the accompanying drawing.

BRIEF DESCRIPTION OF THE DRAWINGS

FIG. 1 is a side-elevational view of a garage door hardware guard embodying the present invention;

FIG. 2 is a front view of the guard shown in FIG. 1;

FIG. 3 is the bottom view of the hardware guard shown in FIG. 1;

FIG. 4 is a transverse sectional view, in enlarged scale, taken along the line 4—4 of FIG. 3;

FIG. 5 is a transverse sectional view, in enlarged scale, taken along the line 5—5 of FIG. 1;

FIG. 6 is a sectional view, in enlarged scale, taken along the line 6—6 of FIG. 1;

DESCRIPTION OF THE PREFERRED EMBODIMENT

Figure 7:
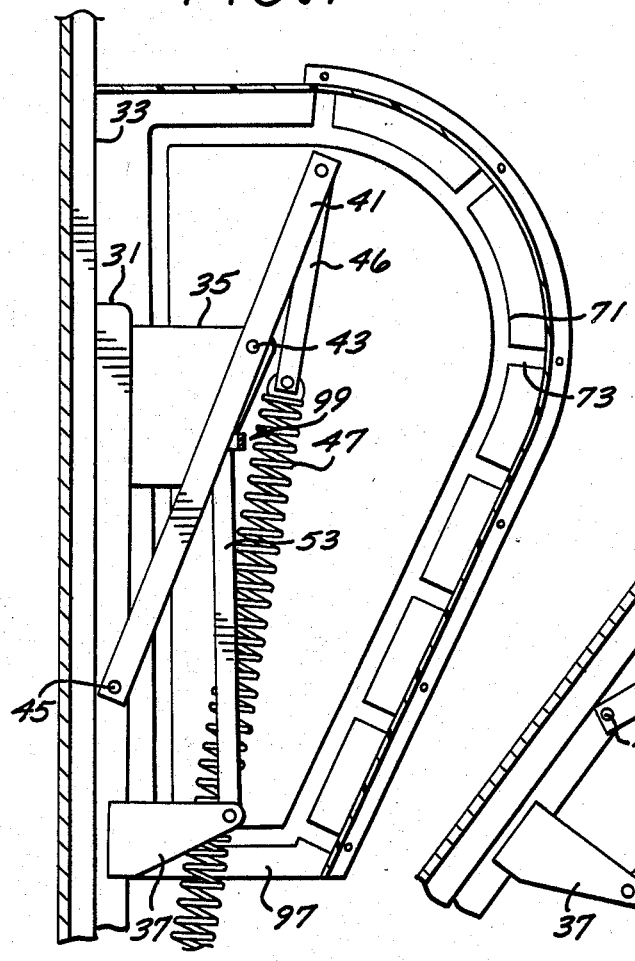
FIG. 7 is a vertical sectional view, in enlarged scale, taken along the line 7—7 of FIG. 3.

The garage door hardware guard apparatus of the present invention includes, generally, right and left-hand harp-shaped guards 21 and 23 (FIGS. 1 and 3) which project co-extensive with one another on the opposite sides of the garage door hardware, generally designated 25, and around the upper and vertical free peripheries thereof to encapsulate such hardware. The right hand guard 21 is formed at its vertical rear extremity with an inturned mounting flange 27 (FIG. 5) which mounts the apparatus from the door jamb 29.

The garage door hardware 25 to be covered by the guard apparatus of the present invention is of conventional construction and includes a vertical angle iron 31 (FIG. 7) attached to the side frame of the one-piece door 33 and a top plate 35 mounted on the door jamb 29 and a bottom bracket 37 mounted from the door 33 by means of the angle iron 31. A booster lever 41 is mounted centrally from the jamb plate 35 by means of a pivot pin 43 with one end thereof being pivotally connected to the door angle iron 31 by means of a pivot pin 45 and the opposite end being connected through a link 46 to the top end of the booster spring 47. The bottom end of the booster spring 47 is then anchored to the door jamb 29 by means of an anchor chain 51. A control lever 53 (FIG. 7) has its top end connected to the jamb plate 35 by means of a pivot pin 55 (FIG. 10) and its bottom end connected with the door bracket 37.

Figure 8:
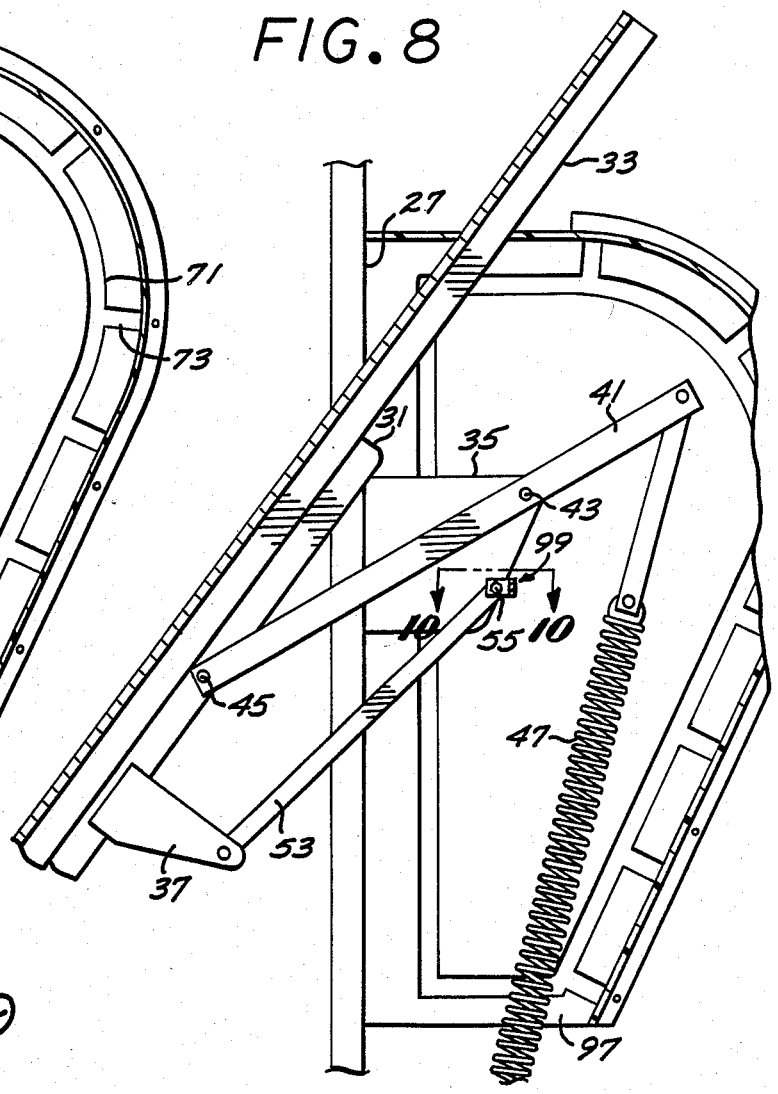
FIG. 8 is a vertical sectional view similar to FIG. 7 but showing the garage door partially open.
Figure 9:
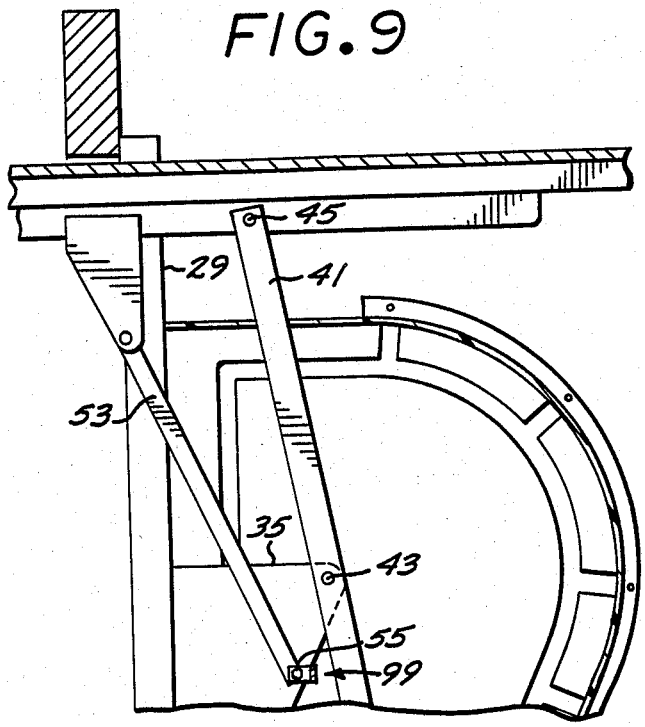
FIG. 9 is a vertical sectional view similar to FIG. 8 but showing the garage door fully open.

It is a characteristic of this type of hardware that, when the door is in the closed position shown in FIG. 7, the spring 47 is in its fully extended and stretched position. The hardware then projects laterally from the door and jamb being disposed in a generally vertical configuration as shown in FIG. 7. As the door is gradually opened the booster lever 41 pivots about its pivot pin 43 through the position shown in FIG. 8 to carry the bottom of the door generally upwardly and outwardly, the path thereof being controlled by such arm in conjunction with the control arm 53 to cause it to approach the horizontal position shown in FIG. 9. In this travel the bottom of the booster arm 41 attached to the lower part of the door moves through a circular path carrying it to its uppermost position disposed laterally, inwardly from the jamb 29 as shown in FIG. 9. It is this travel of the hardware which is shrouded by the hardware assembly of the present invention.

To accommodate the configuration of this hardware as it moves the door from its closed to open position, the guards 21 and 23 are generally harp-shaped, formed with a generally straight side adjacent the door jamb 29. The right-hand guard 21 which acts as the mounting guard, is formed with a generally planar wall 61 formed at its one extremity with the inturned mounting flange 27 Such mounting flange 27 is formed along the length thereof with vertically spaced apart mounting bores for receipt of wood screws 62 (FIG. 5) which mount the guard to the door jambs 29. The planar wall 61 is about 41 inches high and terminates at its upper end in a horizontal straight edge which extends outwardly from the jamb approximately 11 inches (FIG. 1), then curving downwardly at a radius of about 13 inches to a point approximately on the same horizontal plane as the center of curvature. From there it angles downwardly and inwardly to terminate in a straight horizontal bottom edge 63 having a horizontal width from the mounting flange of about one foot.

Referring to FIG. 3, the right-hand guard 21 is formed around its extended periphery with an inturned web or flange 65 defining a peripheral wall which is formed at its inner extremity with a flared out lip 67 formed with spaced apart bores 69 (FIG. 7) for receiving respective Tinnerman "U" type speed nut fasteners 71 for fastening the guards 21 and 23 together. The guard is formed from black, opaque, high-density polyethelyne having a thickness of about 0.090 inches and is formed in its border area with a pressed out reinforcing rib 70 generally following the periphery of such guard; short radial ribs 73 spanning outwardly therefrom to wrap around and form terminal extremities thereof in the peripheral flange 65 (FIG. 2).

The complementally shaped left-hand guard 23 is likewise constructed of black, opaque polyethelyne and it formed with a planar wall 75 coextensive with the wall 61 and further formed near its border with a reinforcing rib 77 and likewise having short radial ribs 79 which wrap over onto an inturned peripheral flange 81 (FIGS. 2 and 3). Such peripheral flange is formed with an outwardly turned lip 83 abutting against the lip 67 and being formed with bores 85 (FIG. 7) aligned with the bores 69 for receipt of the respective fastener 71. It will be appreciated that the left-hand guard 23 is hung from the right-hand guard 21 and terminates in its rearward side in a vertical edge 91 (FIG. 1) spaced from the door jamb and which, at about a $\frac{3}{4}$ of the way up the guard, curves radially outwardly along a curve 93 to meet the top edge. The guards are so configured as to space the planar walls 61 and 75 apart about 5 inches to accommodate articulation therewithin of the hardware linkages.

It will be appreciated that the peripheral flanges 65 and 81 wrap upwardly around the curved portion of the guard as shown in FIG. 1 to terminate in a vertical plane coextensive with the top end 95 of the lip 83 to form a top opening for passage therein of the booster lever 41 when in its uppermost position in FIG. 9. Likewise, it will be appreciated that such peripheral flanges 65 and 81 terminate at the bottom ends of the planar walls 61 and 75 to form between such walls a bottom opening 97 for passage therethrough of the lower extremity of the spring 47.

Figure 10:
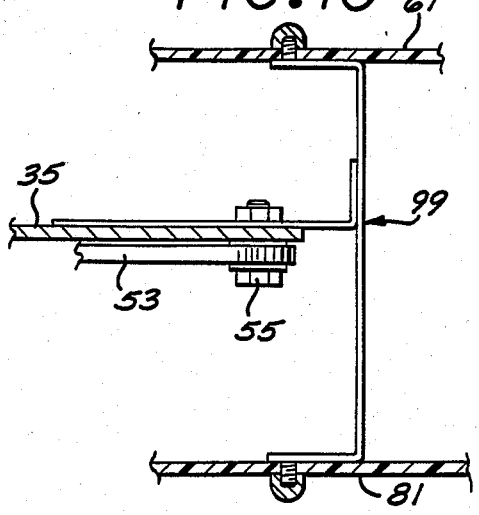
FIG. 10 is a transverse sectional view, in enlarged scale, taken along the lines 10—10 of FIG. 8.

Mounted centrally between the planar walls is a generally T-shaped mounting bracket, generally designated 99 (FIG. 10 . The mounting bracket 99 is formed with a cross brace 101 turned back on its opposite ends to form end flanges 103 having studs mounted therein and projecting outwardly through bores formed in such planar walls to have fastening nuts 10 screwed onto the outer ends thereof. A mounting strap 107 forms the central leg of the bracket 99 and is formed with a longitudinal slot 109 which receives the shank of the pivot pin 55 mounting the end of the control lever 53 for mounting such bracket from the upper jamb plate 35 to thereby support the central portion of the guards 21 and 23.

In operation, it will be appreciated that the guards 21 and 23 may be sold separately from the garage door hardware 25 and may conveniently be installed after the hardware is in place. Installation may be easily achieved by positioning the right-hand guard 2 adjacent the hardware with the mounting flange 27 (FIG. 5) abutted against the jamb 29 so access may be had through the predrilled bores of such mounting flange to mark the jamb for drilling of bores for receipt of the mounting screws 62. The guard 21 may then easily be secured in position on such jamb. One side of the mounting brackett 99 may then be secured to the planar wall 61 by inserting one of the threaded studs through the bore therein and securing the nut 105 in position. Concurrently, the pivot pin 55 may be removed and reinserted through the slot 109 of the strap 107 to secure such strap in position.

The left-hand guard 23 may then be mated against the right-hand guard 21 and the fasteners 71 inserted in the bores in the lips 67 and 83 to secure the guards together. It will be appreciated that the hardware linkage will thus be concealed from view and that protection will be afforded against uncontrolled whipping about of the spring 47 in the event of rupture. That is, should the spring 47 rupture or, for instance, the bottom anchor pulled loose from the jamb 29 while the spring is under tension, the force of the spring will be directed generally upwardly into the confines of the guard assembly to thus be confined against escape to the surrounding environment. In addition, the moving parts of the hardware are shielded during operation to protect the limbs and fingers of passersby from making direct contact with any of the moving parts thereof.

It will be appreciated from the foregoing that the guard assembly of the present invention is economical to manufacture, convenient to install and affords a highly reliable safety shroud protecting nearby persons and vehicles from damage in the event of spring rupture.

Various modifications and changes may be made with regard to the foregoing detailed description without departing from the spirit of the invention.

I claim:

1. Guard apparatus for shrouding spring loaded garage door hardware of the type which mounts one side of a one-piece overhead garage door to a door jamb, such hardware being of the type which projects laterally from said door jamb and is formed with oppositely facing first and second sides, said apparatus comprising:

a first guard including a mounting flange for mounting on said jamb and formed with a first planar wall projecting from said flange along said first side of said hardware to cover said one side and formed at its periphery with a first peripheral flange projecting laterally of said first planar wall and terminating in a first mating lip;

a second guard formed with a second planar wall for projecting coextensive with such second side of such hardware and including a second peripheral flange projecting laterally of said second planar wall and terminating in a mating lip for mating with said first mating lip, said first and second peripheral flanges being so shaped and configured as to, when mated together, maintain said first and second planar walls spaced apart to form an envelope for accommodation of such hardware as said door is opened and closed;

mounting means for mounting said mounting flange to said jamb; and fastening means for fastening said first and second mating lips together whereby said first guard may be mounted to said jamb and said second guard fastened thereto to cause said guards to form an envelope around said hardware to, in the event of rupture of said spring, contain segments of such spring within said envelope against being propelled therefrom under the influence of the release of pent up energy.

2. A guard apparatus according to claim 1 wherein: said first and second guards are generally harp-shaped in elevation.

3. A guard apparatus according to claim 1 wherein: said guards are constructed of plastic.

4. A guard apparatus according to claim 1 wherein: said guards are constructed of high density polyethylene.

5. A guard apparatus according to claim 1 wherein: said guards are so configured as to form an envelope which is open on the side facing said jamb.

6. A guard apparatus according to claim 1 for use with garage door hardware including a main pivot plate including a cantilever bar pivot pin and that includes:

a generally T-shaped mounting bracket including a first leg formed with a slot for receipt of such pivot pin for mounting of said bracket on said pivot pin and laterally projecting arms including respective returns juxtaposed with the respective first and second planar walls and including threaded studs projecting therefrom;

said first and second planar walls are formed with respective bores for receipt of said respective studs; and nuts for screwing onto said studs.

7. A guard apparatus according to claim 1 wherein: said first and second guards are formed on their top sides with openings for receipt therein of portions of said hardware when such door in its open position.

8. A guard apparatus according to claim 1 wherein: said first and second guards are constructed of opaque material.

9. A guard apparatus according to claim 2 wherein: said guards are constructed of plastic.

10. A guard apparatus according to claim 2 wherein: said guards are so configured as to form an envelope which is open on the side facing said jamb.

11. A guard apparatus according to claim 2 wherein:

a generally T-shaped mounting bracket including a first leg formed with a slot for receipt of such pivot pin of mounting of said bracket on said pivot pin and laterally projecting arms including respective returns juxtaposed with the respective first and second planar walls and including threaded studs projecting therefrom;

said first and second planer walls are formed with respective bores for receipt of said respective studs; and nuts for screwing onto said studs.

12. A guard apparatus according to claim 3 wherein: said guards are constructed of plastic having a wall thickness of substantially 0.090 inches.

* * * * *